US006430877B1

(12) United States Patent
Rosenquist et al.

(10) Patent No.: US 6,430,877 B1
(45) Date of Patent: Aug. 13, 2002

(54) POD DOOR ALIGNMENT DEVICE

(75) Inventors: Frederick T. Rosenquist, Redwood City; Perry A. Peterson, Mountain View, both of CA (US)

(73) Assignee: Asyst Technologies, Inc., Fremont, CA (US)

( * ) Notice: Subject to any disclaimer, the term of this patent is extended or adjusted under 35 U.S.C. 154(b) by 0 days.

(21) Appl. No.: 09/114,711

(22) Filed: Jul. 13, 1998

(51) Int. Cl.[7] ..... E05C 9/00
(52) U.S. Cl. ..... 49/395
(58) Field of Search ..... 49/394, 395, 319, 49/320, 321, 279, 280

(56) References Cited

U.S. PATENT DOCUMENTS 4,288,944 A * 9/1981 Donovan ..... 49/395
4,543,748 A * 10/1985 North ..... 49/395
4,891,910 A * 1/1990 Cook et al. ..... 49/395
4,971,369 A * 11/1990 Jean ..... 49/395 X

* cited by examiner

*Primary Examiner*—Jerry Redman
(74) *Attorney, Agent, or Firm*—O'Melveny & Myers LLP

(57) ABSTRACT

A system is disclosed for ensuring a properly aligned position of a pod door within the opening in a pod shell upon location of the pod at a tool load port. The door positioning assembly according to the present invention includes a cam affixed to rotating latch hubs of a pod door latching assembly, and a cam follower mounted around each of the cams, which followers include arm portions that extend out toward an edge of the pod door. When the pod door and shell are separated, the arm portions are held in a retracted position completely contained within the footprint of the pod door. However, upon rejoining the pod door to the pod shell, mechanisms in the port door rotate the latch hub cams. Cam rotation causes translation of the arm portions of the cam followers so that the ends of the arm portions extend out beyond an edge of the pod door and against a surface of the pod shell. In their extended positions, the arm portions maintain a desired vertical positioning of the pod door within the pod shell opening. Moreover, as the arm portions remain in their extended positions after the pod door is coupled to the pod, the positioning assemblies prevent the door from sagging downward in the pod shell opening as a result of its own weight or as a result of a shock or jolt to the pod.

21 Claims, 12 Drawing Sheets

POD DOOR ALIGNMENT DEVICE

BACKGROUND OF THE INVENTION

1. Field of the Invention

The present invention relates to the transfer of workpieces such as semiconductor wafers from a storage and transport pod to a process tool, and in particular to a system for ensuring a properly aligned position of a pod door within the opening in a pod shell upon location of the pod at a tool load port.

2. Description of Related Art

A SMIF system proposed by the Hewlett-Packard Company is disclosed in U.S. Pat. Nos. 4,532,970 and 4,534,389. The purpose of a SMIF system is to reduce particle fluxes onto semiconductor wafers during storage and transport of the wafers through the semiconductor fabrication process. This purpose is accomplished, in part, by mechanically ensuring that during storage and transport, the gaseous media (such as air or nitrogen) surrounding the wafers is essentially stationary relative to the wafers, and by ensuring that particles from the ambient environment do not enter the immediate wafer environment.

A SMIF system has three main components: (1) minimum volume, sealed pods used for storing and transporting wafers and/or wafer cassettes; (2) an input/output (I/O) minienvironment located on a semiconductor processing tool to provide a miniature clean space (upon being filled with clean air) in which exposed wafers and/or wafer cassettes may be transferred to and from the interior of the processing tool; and (3) an interface for transferring the wafers and/or wafer cassettes between the SMIF pods and the SMIF minienvironment without exposure of the wafers or cassettes to particulates. Further details of one proposed SMIF system are described in the paper entitled "SMIF: A TECHNOLOGY FOR WAFER CASSETTE TRANSFER IN VLSI MANUFACTURING," by Mihir Parikh and Ulhrich Kaempf, *Solid State Technology,* July 1984, pp. 111–115.

Systems of the above type are concerned with particle sizes which range from below 0.02 microns ($\mu$m) to above 200 $\mu$m. Particles with these sizes can be very damaging in semiconductor processing because of the small geometries employed in fabricating semiconductor devices. Typical advanced semiconductor processes today employ geometries which are one-half $\mu$m and under. Unwanted contamination particles which have geometries measuring greater than 0.1 $\mu$m substantially interfere with 1 $\mu$m geometry semiconductor devices. The trend, of course, is to have smaller and smaller semiconductor processing geometries which today in research and development labs approach 0.1 $\mu$m and below. In the future, geometries will become smaller and smaller and hence smaller and smaller contamination particles and molecular contaminants become of interest.

SMIF pods are in general comprised of a pod door which mates with a pod shell to provide a sealed environment in which wafers may be stored and transferred. So called "bottom opening" pods are known, where the pod door is horizontally provided at the bottom of the pod, and the wafers are supported in a cassette which is in turn supported on the pod door. It is also known to provide "front opening" pods, in which the pod door is located in a vertical plane, and the wafers are supported either in a cassette mounted within the pod shell, or to shelves mounted directly in the pod shell itself.

In order to transfer wafers between a SMIF pod and a process tool within a wafer fab, a pod is typically loaded either manually or automatedly onto a load port on a front of the tool so that the pod door lies adjacent the port door of the process tool. Thereafter, mechanisms within the load port advance the pod to the port, where the port door decouples the pod door from the pod shell and moves the pod door and port door together into the minienvironment and then off to the side. The pod shell remains in position against the interface port to maintain a seal at the port and to define a sealed, clean environment including the interior of the process tool and pod shell. A wafer handling robot within the process tool may thereafter access particular wafers supported in the pod shell for transfer between the pod and the process tool.

During wafer storage and transport, the pod door is typically held affixed to the pod shell by a latch assembly such as disclosed in U.S. Pat. No. 4,995,430, entitled "Sealable Transportable Container Having Improved Latch Mechanism", to Bonora et al., which patent is owned by the assignee of the present application. The mechanism disclosed therein includes a two-stage latching operation to securely latch a pod door to a pod shell as shown in prior art FIGS. 1 and 2A–2B. The latch assembly is mounted within the pod door, and includes a latch hub 10 which engages first and second translating latch plates 12. Mechanisms in the form of driven latch keys extend from the port door into slots 13 formed in the latch hub to thereby rotate the latch hubs clockwise and counterclockwise. Rotation of each latch hub 10 will cause translation of the first and second latch plates 12 in opposite directions.

FIG. 1 is a front view of an interior of the pod door illustrating the latch assembly in the first stage of the door latching operation. When a pod door is returned from its engagement with the port door to the pod, mechanisms within the port door rotate the latch hub 10 to thereby translate the latch plates 12 outwardly so that latch fingers 14 on the ends of the latch plates 12 extend in the direction of arrows A into grooves formed in the pod shell. FIG. 2A is a side view through line 2—2 of the latch assembly shown in FIG. 1, and FIG. 2B is a side view as in FIG. 2A but illustrating the second stage of the door latching operation. In particular, the latch hub 10 further includes a pair of ramps 16 so that, after the fingers have engaged within the grooves of the pod shell, further rotation of the hub causes the ends 18 of the latch plates engaged with the hub to ride up the ramps. This causes the latch plates to pivot in the direction of arrows B, about axes lying in the plane of each latch plate and perpendicular to the direction of latch plate translation. The effect of this pivoting during the second stage is to pull the pod door tightly against the pod shell to thereby provide a firm, airtight seal between the pod door and shell.

In order to separate a pod door from a pod shell, as when a pod is initially loaded onto a load port interface for wafer transfer, mechanisms within the port door engage the rotatable hub 10 and rotate the hub in the opposite direction than for pod latching. This rotation disengages the latch fingers 14 from the pod shell and allows separation of the pod door from the pod shell.

In order for the decoupling mechanisms within the port door to properly engage and decouple the pod door from the pod shell, it is important that the pod door be properly positioned on the load port. Additionally, port doors include guide pins which register within slots in the pod door with relatively little tolerances. Moreover, in front opening pods, the pods are supported on their bottom surface, but must be accurately registered against a vertical surface (i.e., the port door). All of these factors require that the pod door be properly positioned within the pod when the pod is loaded onto the load port.

However, in order to ensure easy location of the pod door in the pod shell opening, and to prevent frictional engagement between the pod door and pod shell when the door is returned to the pod, a clearance is left on all sides between the pod door and the pod shell. While the clearance between the pod door and pod shell is important when sealing the pod, this clearance may also result in the pod door being off-center when attached to the pod shell or thereafter. This off-centering may occur one of several ways. For example, in front opening pods, the weight of the pod door may cause the door to sag downward in the pod shell opening. Additionally, in either front or bottom opening pods, an unexpected shock or jolt to the pod during transport may cause the pod door to shift off-center within the pod shell opening. As indicated above, unless the pod door is properly centered with respect to the pod shell, the port door gripping mechanisms may not be able to properly engage the pod door latch mechanism, and/or the pod door may not properly align over the registration pins on the port. Further still, improper alignment may result in an undesirable frictional contact between the latch driving mechanisms in the port door and the pod door latch assembly, which frictional contact may generate harmful particulates.

SUMMARY OF THE INVENTION

It is therefore an advantage of the present invention to provide a system for ensuring that a pod door is properly positioned for engagement by a port door upon loading of a pod onto a load port interface.

It is a further advantage of the present invention to provide a mechanism for preventing a pod door in a front opening pod from sagging downward in the pod shell opening.

It is another advantage of the present invention to provide a device for preventing a pod door from shifting out of proper position in the pod shell opening in the event the pod receives an unexpected jolt or shock.

It is a still further advantage of the present invention to provide a system for maintaining a pod door centered with respect to a pod shell, which system may be easily incorporated into an existing pod design.

These and other advantages are provided by the present invention which in general relates to a system for ensuring that a pod door is properly positioned within a pod shell during storage, transfer and loading of the pod onto a load port. A preferred embodiment of the present invention may be added to a conventional door latching assembly within a pod door, and may be driven by the same mechanisms in the port door that actuate the door latching assembly. The door positioning assembly according to the present invention includes a cam affixed to each of the rotating latch hubs of a pod door latching assembly. The cams are located on a side of the latch hubs opposite that including the ramps used to pivot the pod door into tight engagement with the pod cover. The door positioning assembly further includes a cam follower mounted around each of the cams, which followers include arm portions that extend out toward an edge of the pod door.

When the pod door and shell are separated, the arm portions are held in a retracted position completely contained within the footprint of the pod door. However, upon rejoining the pod door to the pod shell, mechanisms in the port door rotate the latch hub cam. Cam rotation causes translation of the arm portions of the cam followers so that the ends of the arm portions extend out beyond an edge of the pod door and against a surface of the pod shell. In their extended positions, the arm portions maintain a desired positioning of the pod door within the pod shell opening. Moreover, as the arm portions remain in their extended positions after the pod door is coupled to the pod, the positioning assemblies will ensure that the pod door is properly positioned in the pod shell opening during pod transfer and loading onto a load port.

A preferred embodiment of the present invention includes two arm portions capable of extending out from a bottom edge of a pod door of a 300 mm front opening pod to prevent sagging of the pod door in the pod shell opening. However, alternative embodiments of the present invention may include a door positioning assembly having a plurality of arm portions extending outward from two or more sides of the pod door. Such an embodiment could be used for bottom or side opening pods.

BRIEF DESCRIPTION OF THE DRAWINGS

The present invention will now be described with reference to the drawings in which.

DETAILED DESCRIPTION

The present invention will now be described with reference to FIGS. 3 through 12 which in general relate to a system for ensuring a pod door is properly positioned with respect to a pod shell upon securing the pod door to the pod shell and thereafter. In a preferred embodiment, the present invention is intended for use with a 300 mm front opening SMIF pod. However, it is understood that the size and type of SMIF pod may vary in alternative embodiments. Moreover, it is understood that the present invention may be used in containers other than SMIF pods, which containers may house various workpieces, including semiconductor wafers, flat panel display, reticles, and the like.

Figure 3:
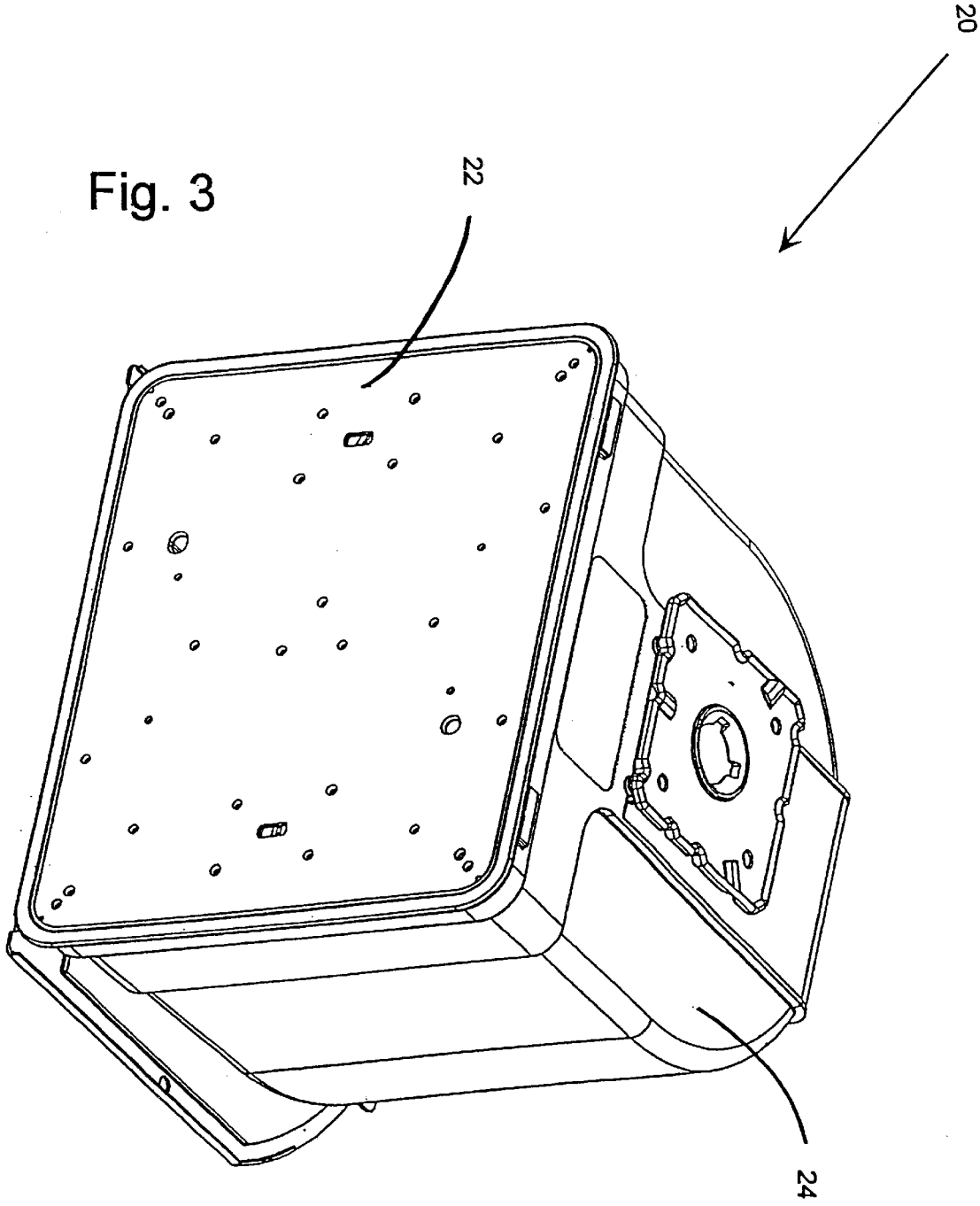
FIG. 3 is a perspective view of a SMIF pod door and pod shell according to the present invention.
Figure 4A:
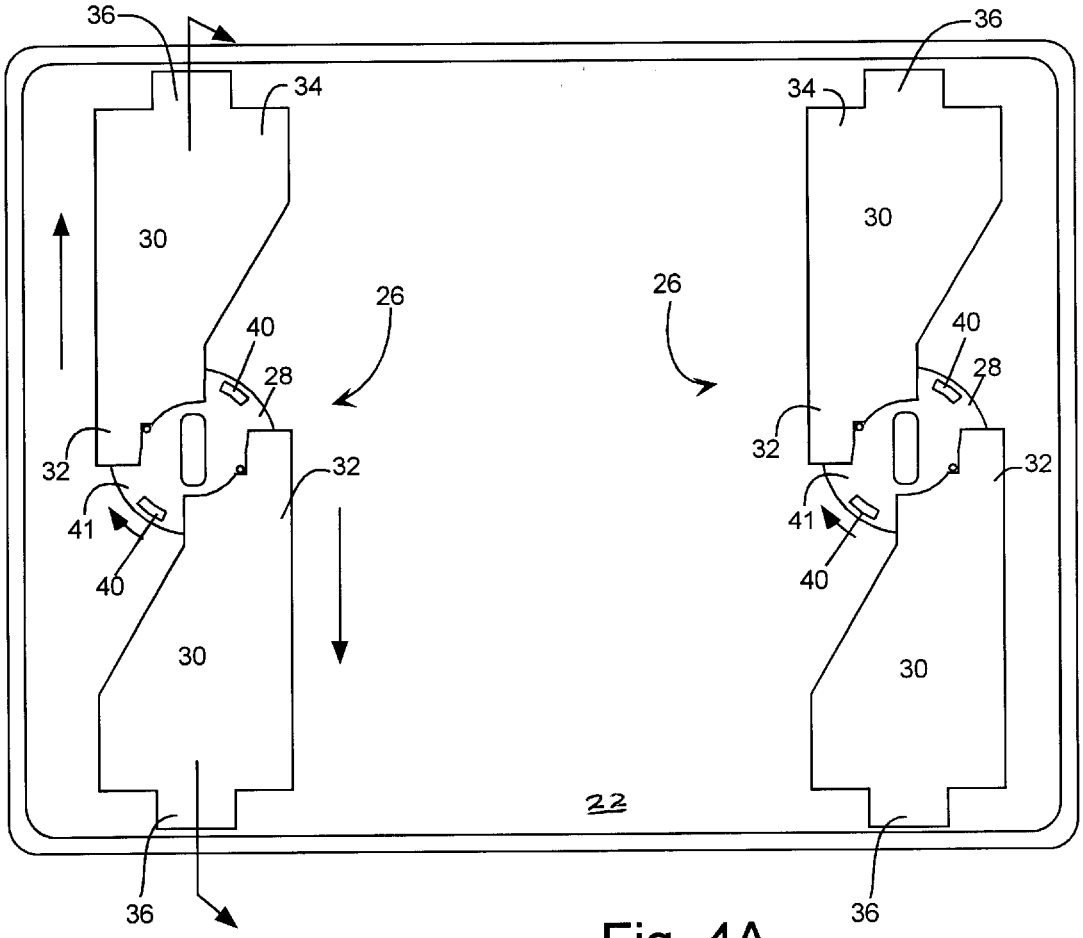
FIG. 4A is a front view of an interior of the pod door of FIG. 3 including a door latching and positioning assembly according to the present invention.
Figure 4B:
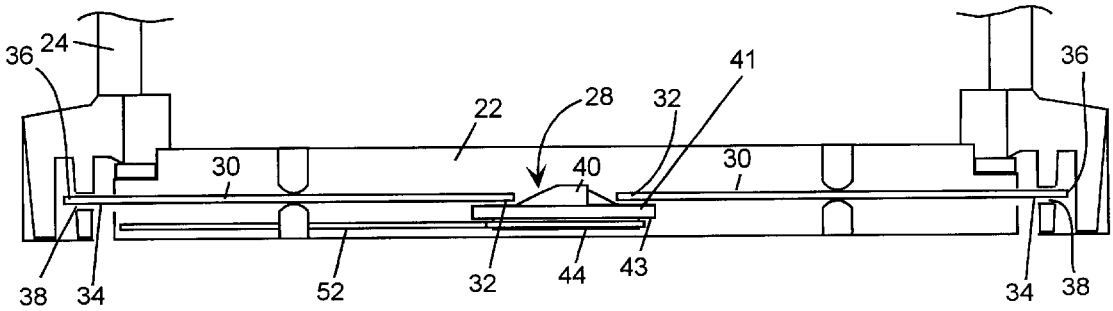
FIG. 4B is a cross-sectional view through line 4—4 of FIG. 3 showing the door latching and positioning assembly according to the present invention.

FIG. 3 shows a SMIF pod 20 comprising a pod door 22 and a pod shell 24. FIG. 4A is a front view of the interior of the pod door 22, and FIG. 4B is a cross-sectional view along line 4—4 through the pod door 22 in FIG. 3. The pod door includes a pair of latch assemblies 26 for securing and properly positioning the door 22 with respect to the pod shell 24. In contrast to prior art latching assemblies, the present invention employs two latching assemblies off to the sides of the pod door to provide greater structural stability and to free up the middle of the pod. It is understood that a single latching assembly may be used in alternative embodiments of the invention. Each latch assembly 26 is structurally and operationally identical to each other, and includes a rotating latch hub 28 engaged with a pair of latch plates 30. In a preferred embodiment, first ends 32 of the latch plates 30 may be affixed to the latch hub 28 at an outer circumference of the latch hub such that rotation of the latch hub will cause outward translation of the latch plates. It is understood that other engagement schemes between the latch hub and latch plates, such as for example a rack and pinion system, are contemplated. Each of the latch plates 30 includes second ends 34 opposite the first ends 32, which second ends each include fmgers 36 provided to fit within grooves 38 in the SMIF pod shell (FIGS. 3 and 4B).

Figure 1:
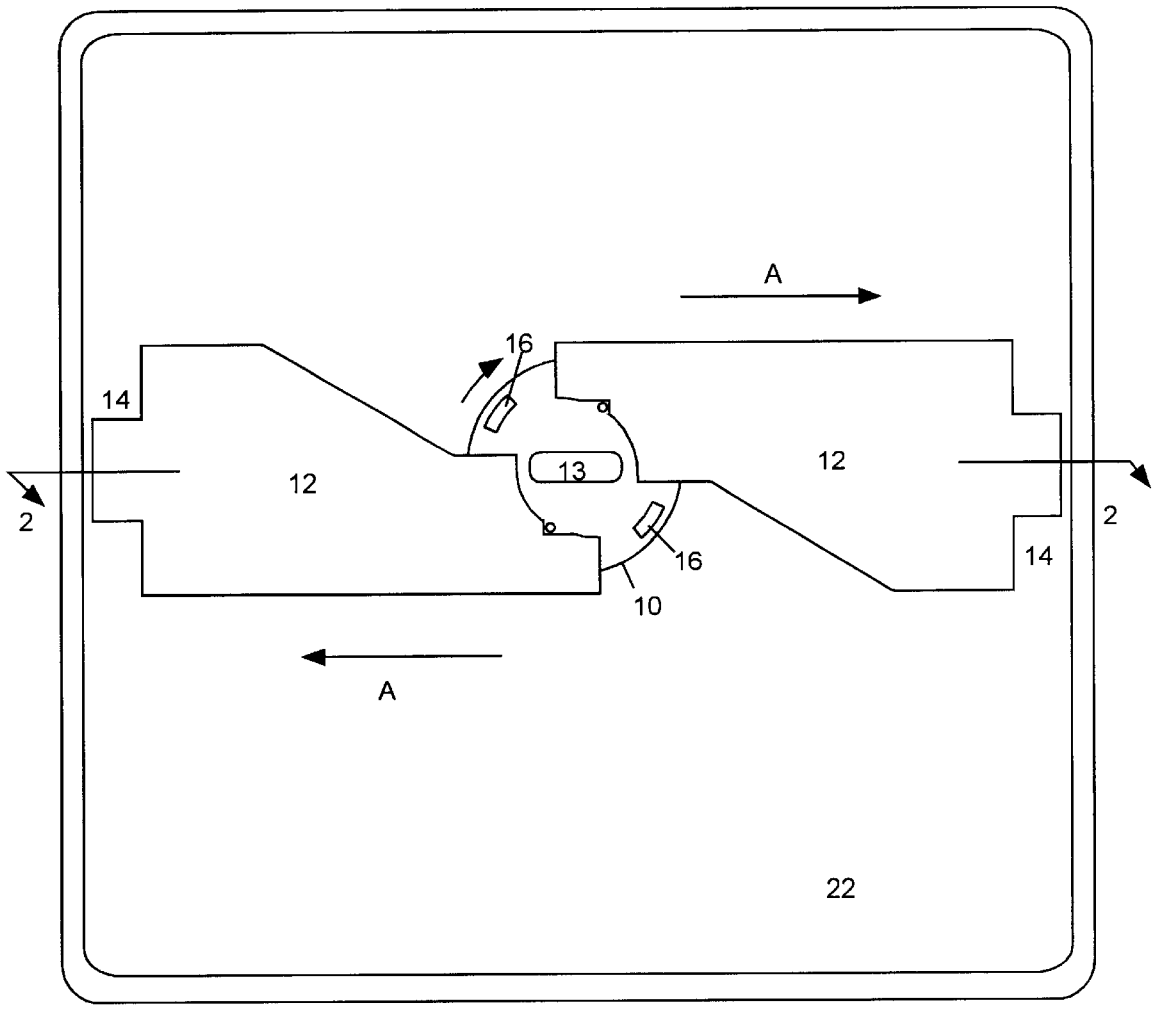
Fig. 1 (Prior Art)
FIG. 1 is a prior art front view of an interior of a pod door including a door latching assembly for latching and unlatching a pod door to a pod.
Figure 2A:
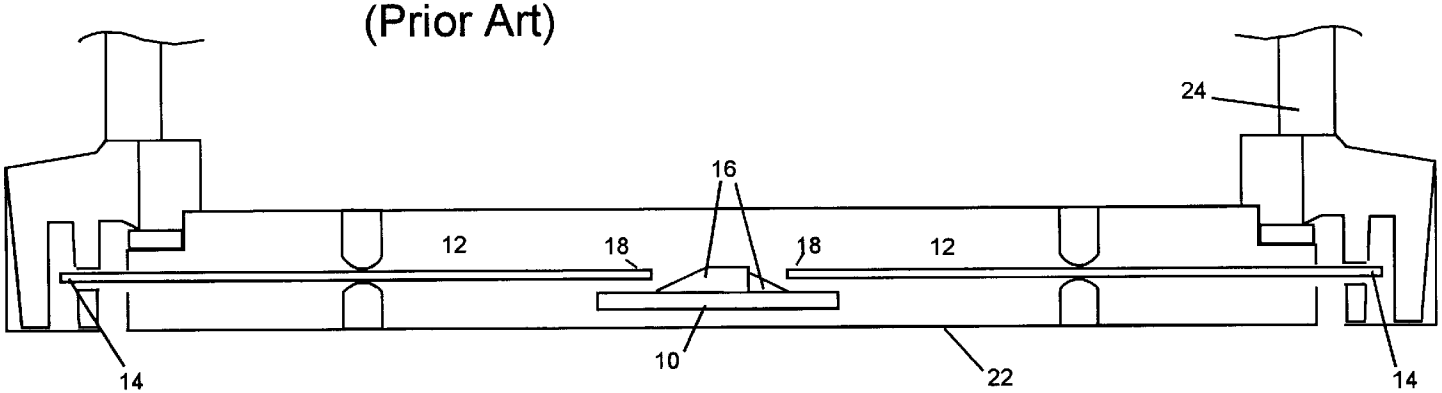
Fig. 2A (Prior Art)
FIG. 2A is a prior art cross-sectional view through line 2—2 of the door latching assembly shown in FIG. 1 after the first stage of the latching operation.
Figure 2B:
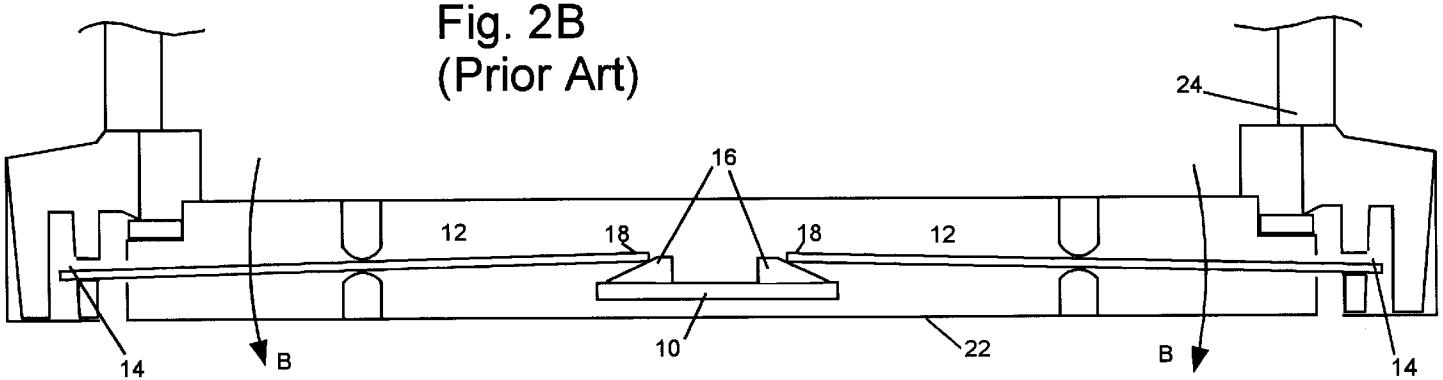
Fig. 2B (Prior Art)
FIG. 2B is a prior art cross-sectional view as in FIG. 2A showing the latching assembly after the second stage of the latching operation.

With respect to latching and unlatching the pod door to the pod shell, each of the latch assemblies 26 preferably operate similarly to the latch assemblies disclosed in U.S. Pat. No. 4,995,430, entitled "Sealable Transportable Container Having Improved Latch Mechanism", which application is assigned to the owner of the present invention, and which application is incorporated by reference herein in its entirety. Namely, each latch assembly includes a two-stage operation for securing the pod door to the pod shell. The first stage is as shown in FIGS. 1 and 2A and as described in the Background of the Invention section. Mechanisms (not shown) in the port door engage and rotate latch hubs 28 to thereby extend the fingers 36 of latch plates 30 outwardly into grooves 38 formed in the pod shell. The second stage is as shown in FIG. 2B and as described in the Background of the Invention section. The latch hub 28 further includes ramps 40 on a side 41 of the hub. After the latch fingers 36 are engaged in the grooves 38, further rotation of the hub causes first ends 32 of the latch plates to ride up the ramps 40, thereby pivoting fingers 36 of each latch plate about axes lying in the plane of the latch plates and perpendicular to the direction of latch plate translation. The effect of this pivoting during the second stage is to pull the pod door tightly against the pod shell to thereby provide a firm, airtight seal between the pod door and shell.

Figure 5:
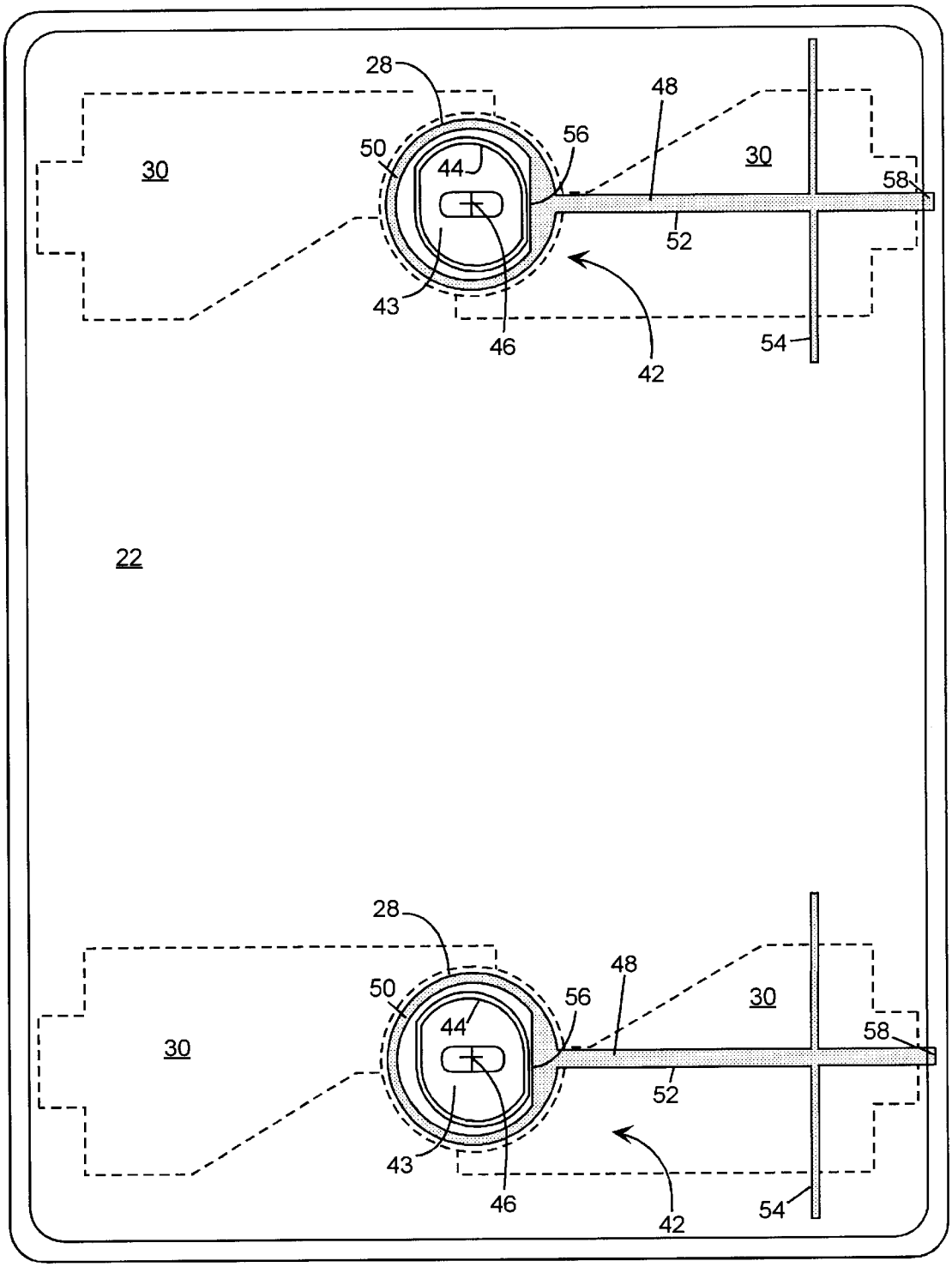
FIG. 5 is a rear view of an interior of the pod door of FIG. 3 including a door latching and positioning assembly according to the present invention with the positioning assembly in a retracted position.

According to the present invention, each of the latch assemblies 26 further include door positioning assemblies 42. FIG. 5 is a rear view of the interior of pod door 22. (The latch hubs 28 and latch plates 30 are shown shaded in the rear view figures so that the door positioning assemblies 42 may be seen more clearly). The embodiment of the present invention shown in FIG. 5 is preferably included in the pod door of a 300 mm front opening pod. However, it is understood that this preferred embodiment may alternatively be included in a bottom opening pod, as well as in pods of varying sizes, including 200 mm pods. As shown in FIGS. 4B and 5, each of the door positioning assemblies includes a cam 44 formed on a surface 43 of the latch hubs 28 opposite surface 41 of the latch hubs. Cam 44 comprises a raised wall on surface 43 of latch hub 28, which raised wall includes sections that lie at varying distances from a radial center 46 of the latch hub 28.

Each of the door positioning assemblies 42 further includes cam followers 48. The cam followers 48 are preferably made of a rigid material, such as for example aluminum or various plastics, and are generally flat, having a thickness of about 1 to 4 mm. It is understood that this thickness may vary in alternative embodiments. In a preferred embodiment, the cam followers 48 include central body portions 50 generally coplanar with and lying circumjacent around the cams 44. Cam followers 48 further include arm portions 52 attached to and extending radially outward from the central body portions 50. In an embodiment of the invention included in a vertically oriented door to a front opening pod, the arm portions 52 preferably extend downward toward the bottom edge of the pod door. In a retracted position (as explained hereinafter), the bottom end 58 of each arm portion may lie near to but within the footprint of the pod door. A leaf spring 54 is formed along, or is otherwise engaged with, the arm portions 52, which leaf spring 54 biases the arm portions toward the radial centers 46 of the latch hubs 28. Each leaf spring 54 serves to bias a cam engaging portion 56 of the central body portions 50 agast the respective cams 44. Those of skill in the art will appreciate that other biasing systems may be used in the place of leaf springs 54. For example, the leaf spring may be omitted, and a cam surface may be provided on a portion of the cam 44 distal from the cam engaging portion 56, which cam surface would engage the central body portion 50 to retract the cam followers back to within the footprint of the pod door.

Figure 6:
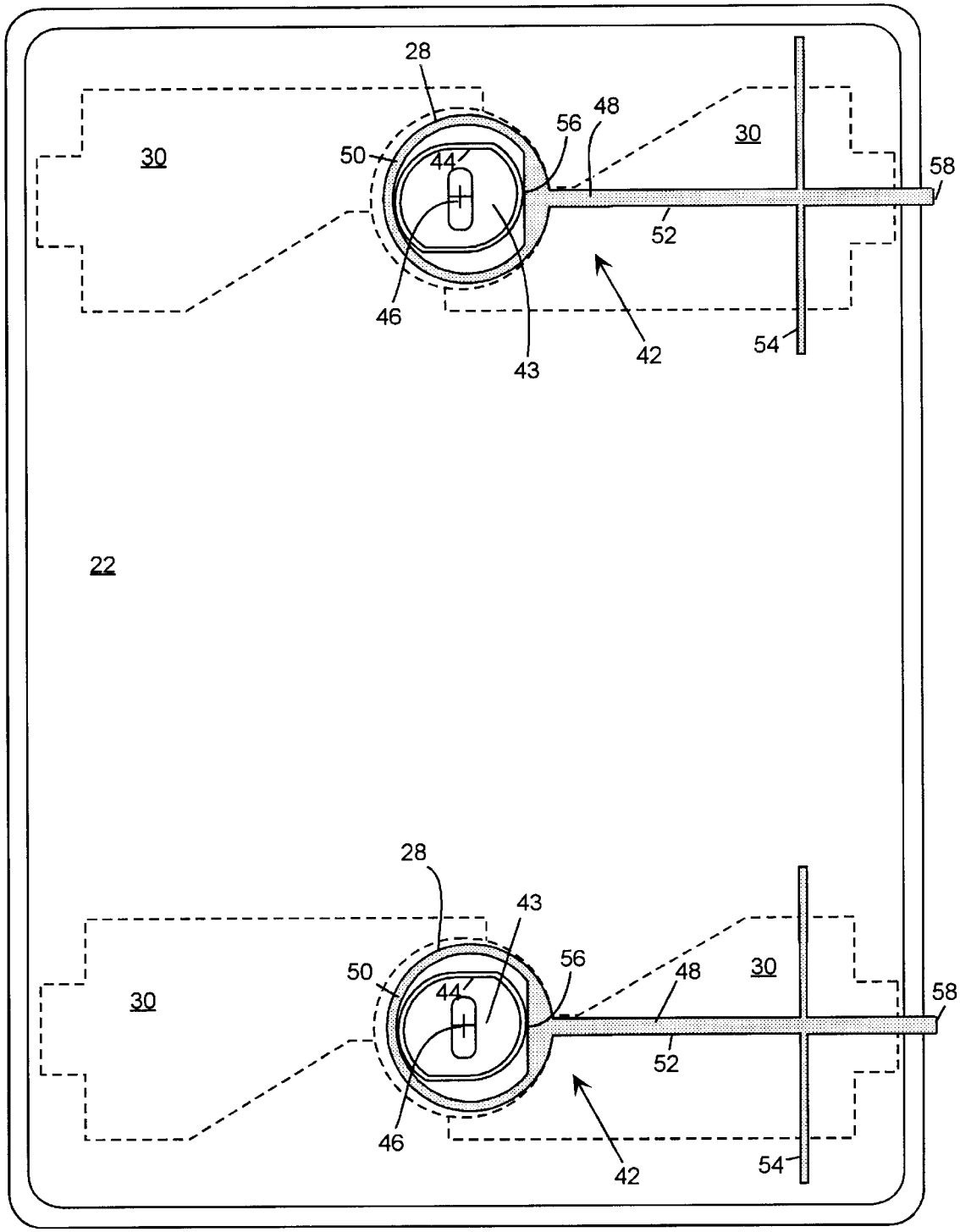
FIG. 6 is a rear view of the interior of the pod door showing the door positioning assembly according to a preferred embodiment of the present invention in an extended position.

While the pod door is separated from the pod, the cam followers 48 are biased into their retracted positions by the leaf springs, completely within the footprint of the pod door. When the pod door is returned to the pod, the latch hubs 28 are rotated by the mechanisms (not shown) in the port door as described above to rotate the latch hubs and cams thereon. Rotation of the cams 44 bias the cam engaging portions 56 of each cam followers outward, to thus translate the arm portions from their retracted to their extended positions, as shown in FIG. 6. In such extended positions, the ends 58 of the arm portions extend out through respective slots (not shown) formed in the lower edge of the pod door, to thereupon abut against a surface 60 of the pod shell.

In a preferred embodiment, in their extended positions, the ends 58 of the arm portions extend approximately 1 to 4 mm, and optimally about 2 to 3 mm beyond the outer edge of the pod door. Thus, in their extended positions, the arm portions will maintain a 1 to 4 mm clearing between the pod door and the pod shell along a bottom surface of the pod door. This spacing represents a proper vertical positioning of the pod door within the pod shell opening. It is understood that these numbers are by way of example and may vary in alternative embodiments. Additionally, as the arm portions remain in their extended positions after the pod door is coupled to the pod, the positioning assemblies 42 prevent the door from sagging downward in the pod shell opening as a result of its own weight or as a result of a shock or jolt to the pod. As such, the pod door will be properly positioned for engagement with port door actuation mechanisms and guide pins when a pod is loaded on a load port of a process tool.

In order to remove a pod door from a pod, the pod door unlatching operation is initiated by the port door mechanisms to thereby rotate the cams 44 in the opposite direction than for pod latching. Such rotation causes the leaf springs to translate the arm portions from their extended positions back to their retracted positions so as not to interfere with the decoupling and separation of the pod door from the pod shell.

The cam 44 on the second side 43 of each latch hub is angularly oriented with respect to the ramps 40 on the first side 41 of each latch hub so that, during rotation of the latch hubs, each cam 44 will translate the arm portions 52 of the door positioning assemblies 42 to their extended positions prior to the first ends 32 of the latch plates engaging and riding up the amps 40. This ensures that door positioning assemblies 42 will properly position the pod door vertically in the opening of the pod shell prior to pivoting of the latch plates to secure the pod door against the pod shell.

In addition to the pod door sagging as a result of the weight of the door in front opening pods, it is possible that a pod door in bottom or front opening pods may shift with respect to the pod shell as a result of a sudden shock or jarring to the pod during transport. As such, in an alternative embodiment of the present invention shown in FIGS. 7 and 8, door positioning assemblies may be provided including arm portions 52 extending outward from the four sides of the pod door so as to fix the position of the door along the four sides of the pod upon the door being recoupled to the pod shell and thereafter.

Figure 7:
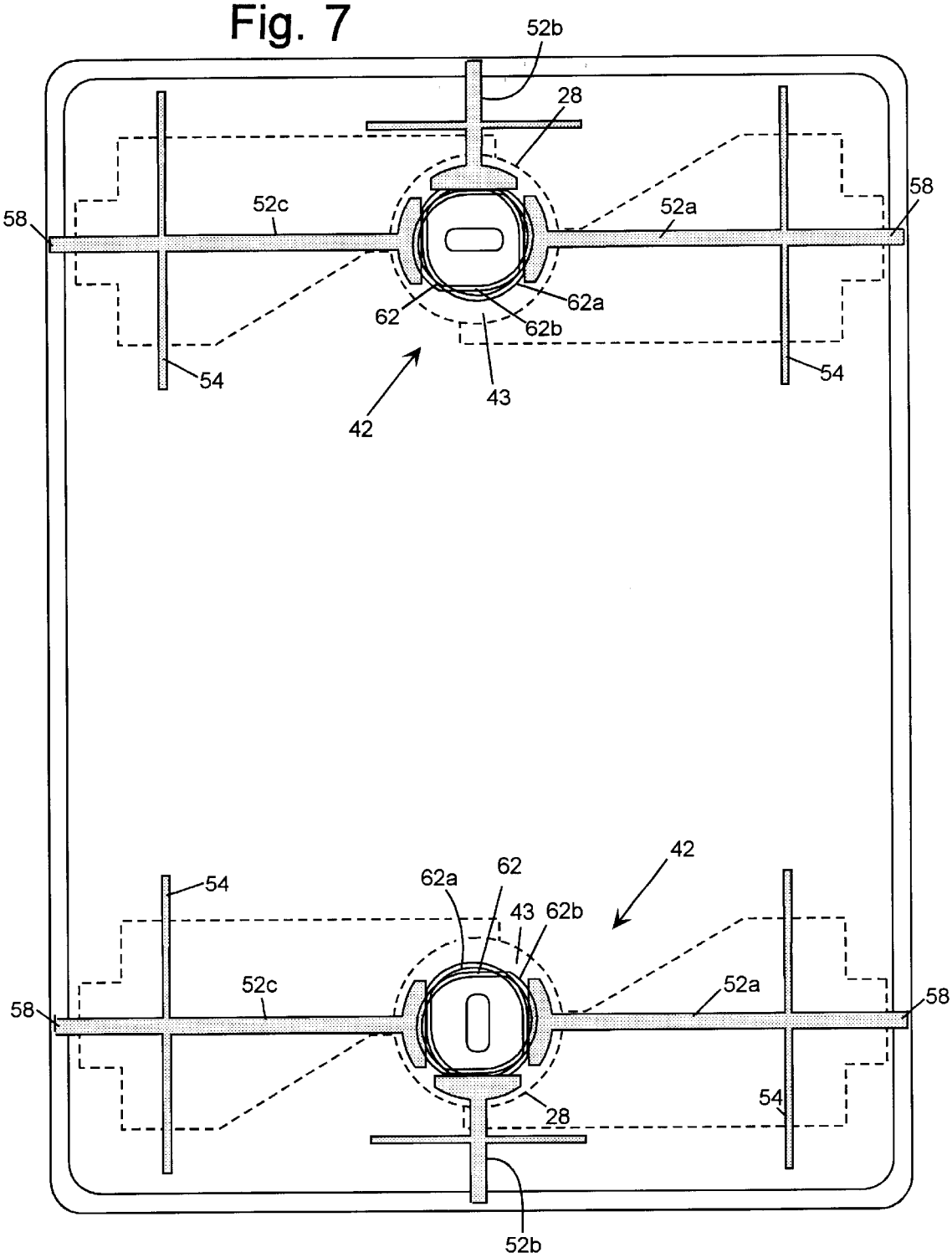
FIG. 7 is a rear view of the interior of the pod door showing the door positioning assembly according to an alternative embodiment of the present invention in a retracted position.
Figure 8:
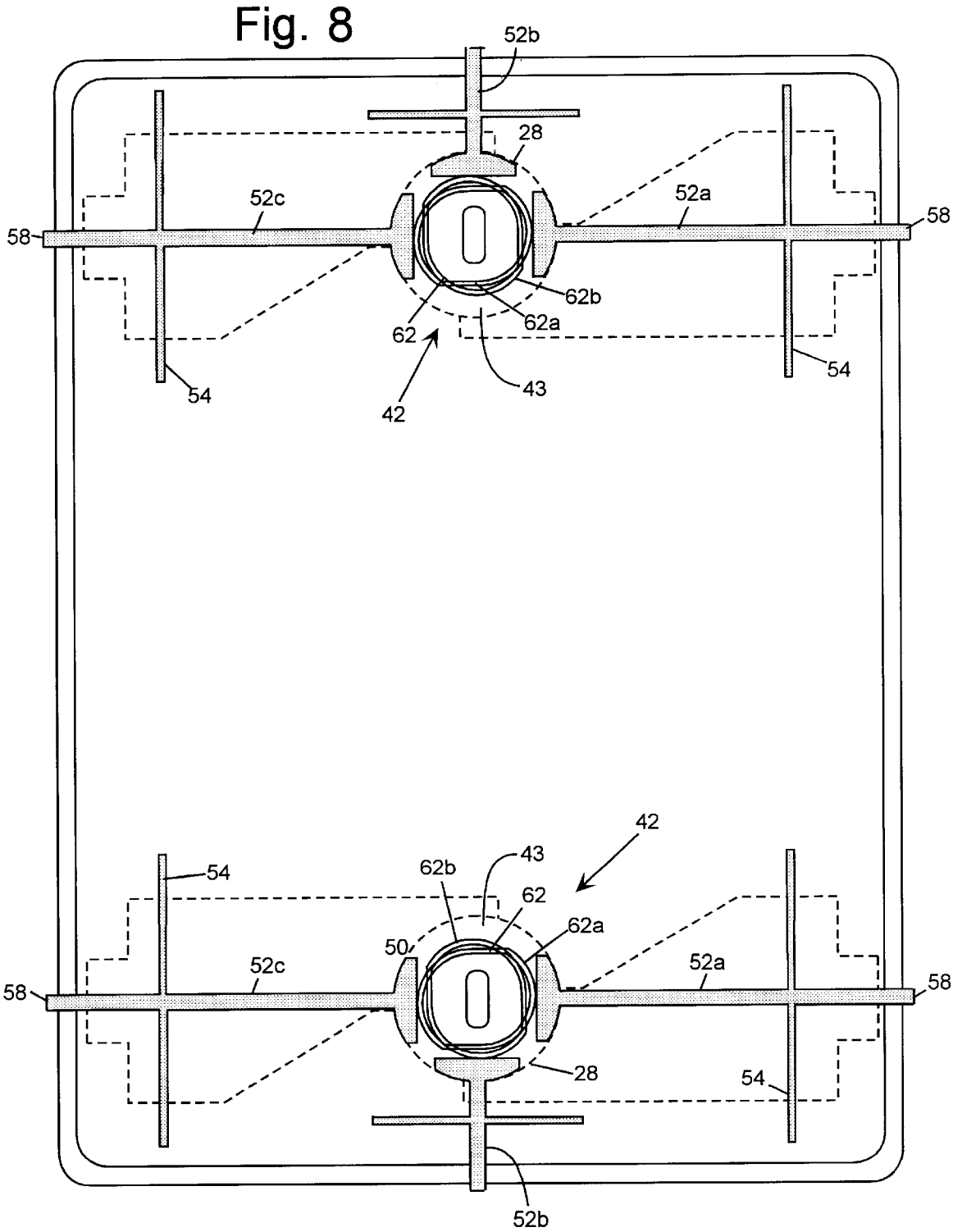
FIG. 8 is a rear view of the interior of the pod door showing the door positioning assembly according to an alternative embodiment of the present invention in an extended position.
Figure 9:
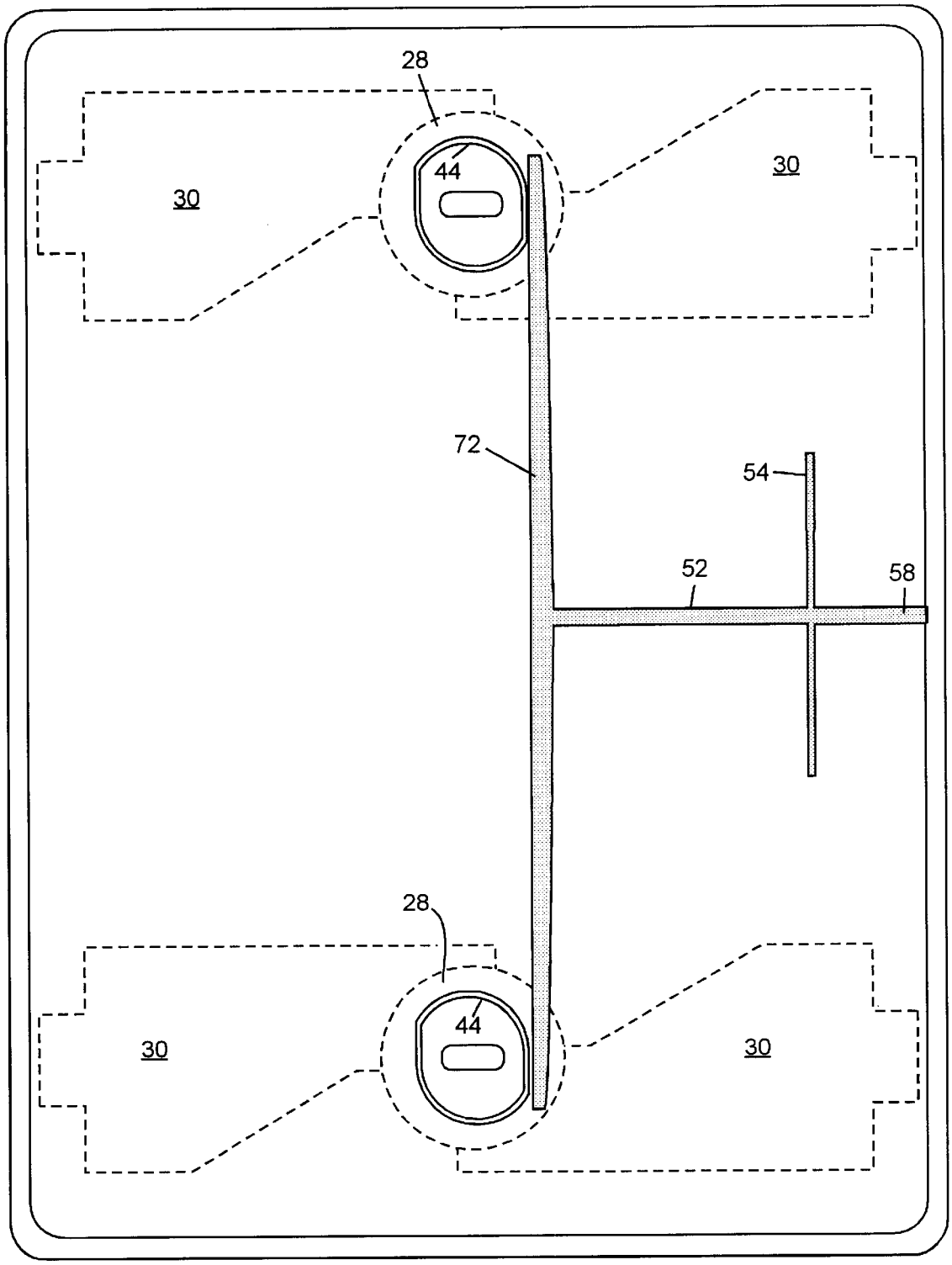
FIG. 9 is a rear view of the interior of the pod door showing the door positioning assembly according to an alternative embodiment including a single arm portion affixed to both rotating latch hubs.

The door positioning assemblies 42 according to the embodiments of FIGS. 7 and 8 each include a multiple apex cam 62 provided on side 43 of the latch hub 28. The multiple apex cam 62 according to one embodiment includes a first cam 62*a* and a second overlapping cam 62*b*. Each of the first and second cams is similar to cam 44, but are 90° out of phase with each other and reside in different planes. The door positioning assemblies 42 according to this alternative embodiment each further include a plurality of arm portions 52*a*, 52*b* and 52*c*. The opposed arm portions 52*a* and 52*c* would reside in the plane of and engage the first cam 62*a*, and the arm portion 52*b* adjacent to the shorter side of the port door would reside in the plane of and engage the second cam 62*b*. It is understood that other configurations of the multiple apex cam 62 are possible. As in the embodiment shown in FIGS. 5 and 6, each of the arm portions include ends 58 lying proximate the outer periphery of the pod door. And each of the arm portions may be biased against the multiple apex cam by leaf springs 54 or similar biasing structure.

In operation, upon rotation of the multiple apex cam 62 on a latch hub by the mechanisms (not shown) in the port door, each of the arm portions engaged with that cam will be translated from a retracted position to an extended position (as shown in FIG. 8). In their extended positions, the ends 58 of each of the arm portions protrude past the outer periphery of the pod door around respective sides of the pod door. Thus, up and down and side to side movement of the pod door with respect to the pod shell is prevented.

In a preferred embodiment, in their extended positions, the ends 58 of the arm portions extend approximately 1 to 4 mm, and optimally about 2 to 3 mm beyond the outer edge of the pod door. Thus, in their extended positions, the arm portions will maintain a 1 to 4 mm clearing between the pod door and the pod shell around the outer periphery of the pod door. This spacing represents a proper positioning of the pod door within the pod shell opening. It is understood that these numbers are by way of example and may vary in alternative embodiments. Additionally, as the arm portions remain in their extended positions after the pod door is coupled to the pod, the positioning assemblies 42 prevent the door from shifting as a result of a shock or jolt to the pod during transport and loading of the pod on a load port.

As in the embodiment of the present invention shown in FIGS. 5 and 6, the multiple apex cam 62 on side 43 of the latch hubs is angularly oriented with respect to the ramps 40 on the first side 41 of the latch hubs so that, during rotation of the latch hubs, each multiple apex cam 62 will translate the arm portions 52 prior to the pod door being pulled into tight engagement with the pod shell.

The embodiment of the present invention illustrated in FIGS. 5 and 6 shows two arm portions 52 capable of extending down out of the bottom of the port door. The embodiment of the present invention illustrated in FIGS. 7 and 8 shows six arm portions 52 capable of protruding out of the bottom, top, and sides of the port door. It is understood, however, that varying numbers of arm portions 52 may be provided in the present invention in alternative embodiments. For example, in the embodiment shown in FIG. 9, a single cam follower 72 is biased against cams on both latch hubs 28 so that, upon rotation of the latch hub and cam, a single end of the cam follower will extend out beyond the periphery of the pod door. It is understood that the number of arm portions 52 may vary from between one and six, or greater, in alternative embodiments of the present invention. Additionally, although each of the arm portions are shown extending generally perpendicularly out toward the pod door edge, it is understood that the arm portions may additionally or alternative extend diagonally out to one or more of the pod door edges.

Figure 10:
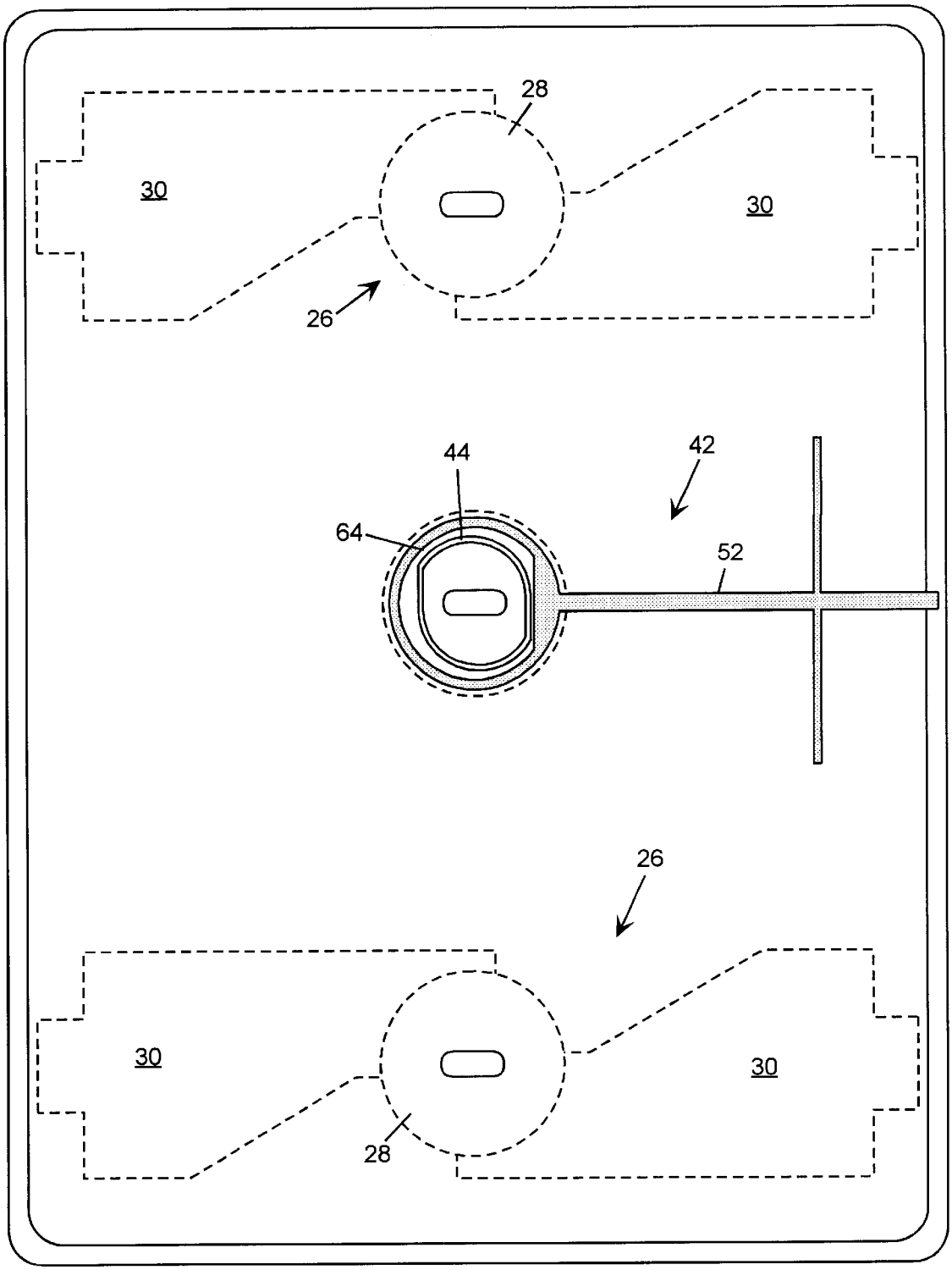
FIG. 10 is a rear view of the interior of the pod door showing the door positioning assembly according to an alternative embodiment of the present invention in which the door positioning assembly is a separate assembly from the door latching assembly.

As described above, the door positioning assemblies 42 according to the various embodiments of the invention are combined as part of, and actuated by, the latch hubs 28 which comprise part of the latch assemblies 26 for coupling and decoupling the pod door from the pod shell. However, it is understood that in alternative embodiments of the present invention, the door positioning assemblies 42 may be completely separate from the latch assemblies 26. Such an embodiment is shown in FIG. 10. First mechanisms (not shown) in the port door would actuate the latch assemblies 26 as described above. In this embodiment, the port door would further include additional mechanisms (not shown) for rotating a positioning hub 64. The positioning hub 64 may include a cam 44 or multiple apex cam 62 as described above, for actuating one or more arm portions between their retracted and extended positions.

Figure 11:
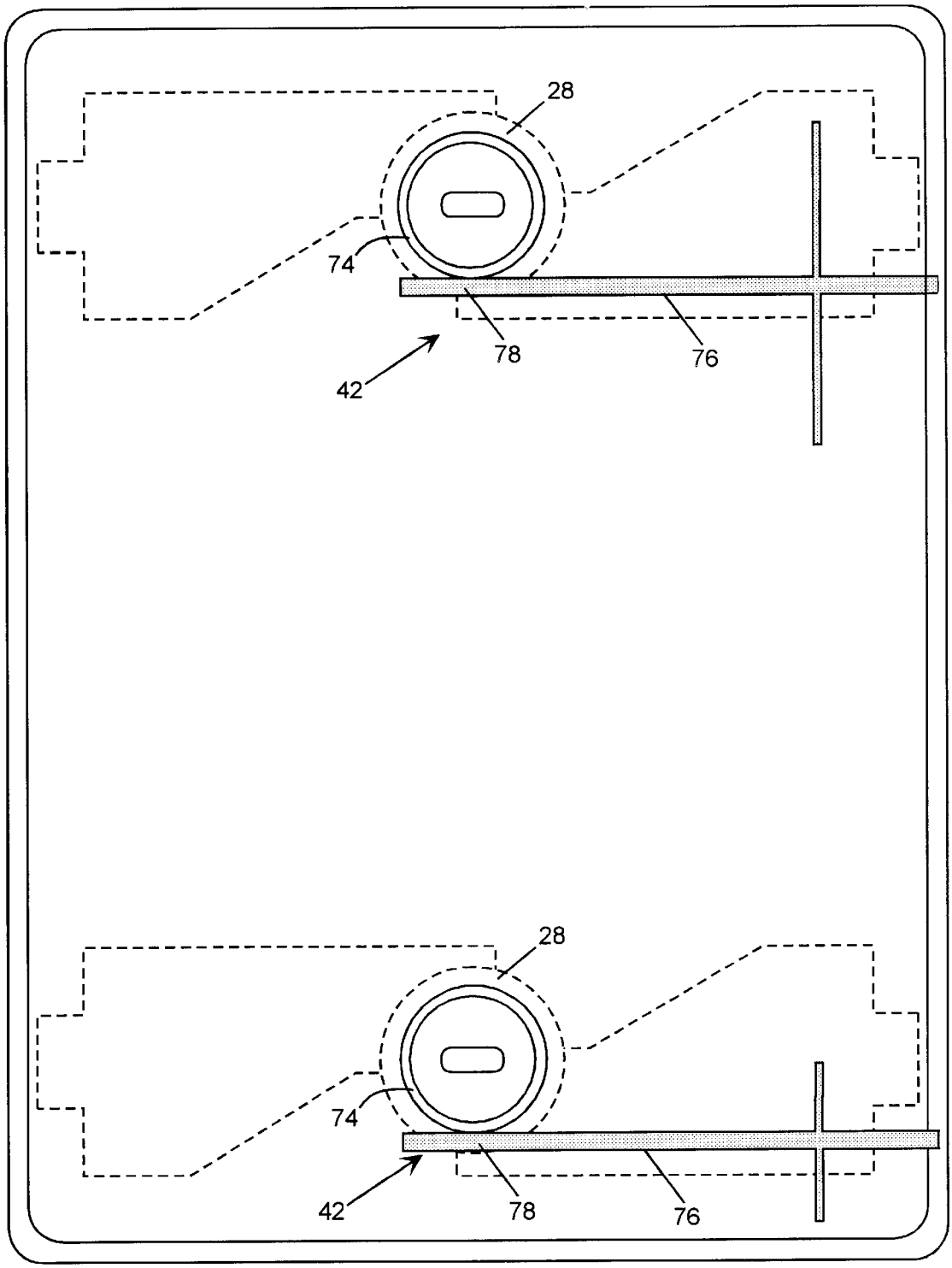
FIG. 11 is a rear view of the interior of the pod door showing the door positioning assembly according to a further alternative embodiment of the present invention including a rack and pinion translation system.
Figure 12:
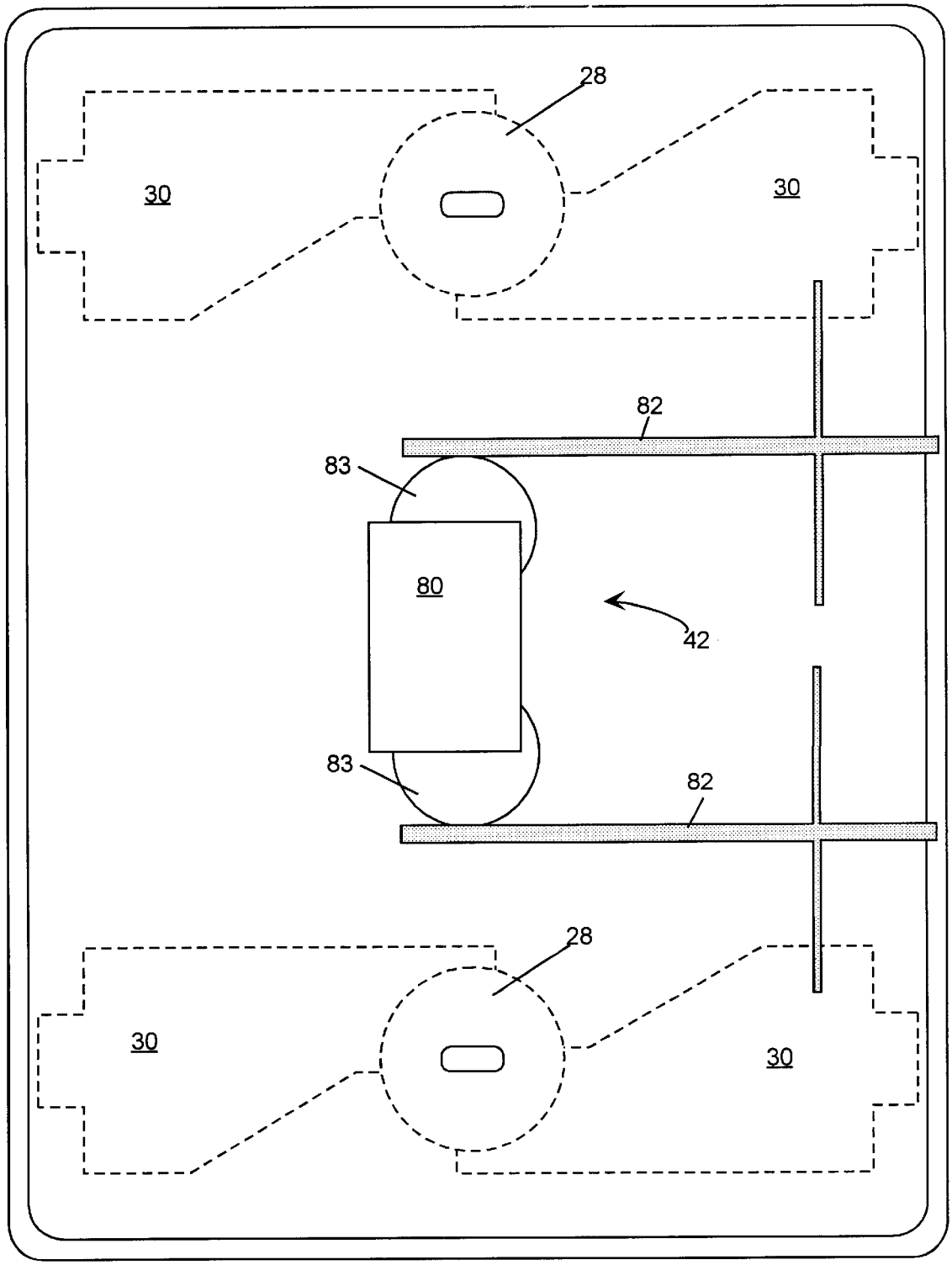
FIG. 12 is a rear view of the interior of the pod door showing the door positioning assembly according to a further alternative embodiment of the present invention including an electrically driven translation system.

As described above, a preferred embodiment of the present invention utilizes cams and various cam followers for actuating the door positioning mechanisms between their retracted and extended positions. However, it is understood that other mechanical and/or electrical assemblies may be utilize to actuate the door positioning assemblies. For example, as shown in FIG. 11, the latch hub 28 (or positioning hub 64 in the alternative embodiment of FIG. 10) may include a pinion gear 74 (shown schematically) engaged with one or more translating positioning members 76. The ends 78 of the translating positioning member 76 lying in engagement with the pinion gear 74 would include rack gear teeth (not shown) meshing with pinion gears 74. Thus, upon rotation of the pinion gear by a mechanism (not shown) in the port door, the translating positioning member 76 will translate between its retracted and extended positions. In a further alternative embodiment shown in FIG. 12, the door positioning assembly may comprise a motor 80 capable of translating positioning members 82 so as to properly position the pod door with respect to the pod shell. As would be appreciated by those of skill in the art, the motor may engage and drive a rotation-to-translation mechanical conversion system 83 to extend and retract the positioning members. Such systems 83 include for example a cam and cam following system or a rack and pinion system. Motor 80 would receive power and control signals via electrical contacts on the port door. Such signals would activate the motor to extend the positioning members upon coupling of the pod door to the pod shell, and retract the positioning members upon separation of the pod door from the pod shell.

It is understood that other configurations of the door positioning assemblies, and drive systems therefor, are contemplated for positioning and maintaining the pod door in the proper position within the opening of the pod shell in alternative embodiments of the present invention.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

We claim:

1. A mechanism for positioning a pod door with respect to an opening in a pod shell and latching the pod door to the pod shell, the mechanism comprising:

a latching member adapted to be movably mounted to a pod door;

a rotatable actuator connected to said latching member, said rotatable actuator moving the latching member into and out of engagement with a pod shell upon rotation of said rotatable actuator; and a positioning member connected to said rotatable actuator, said positioning member being independently movable with respect to the latching member between a first position contained within a footprint of the pod door and a second position in which at least a portion of the positioning member extends beyond the footprint of the pod door into engagement with the pod shell, the positioning member adjusting the position of the pod door with respect to the pod shell as the latching member moves into engagement with the pod shell.

2. A mechanism for positioning a pod door with respect to an opening in a pod shell and latching the pod door to the pod shell, the mechanism comprising:

a latching member adapted to be movably mounted to a pod door;

a rotatable actuator connected to said latching member, said rotatable actuator moving the latching member into and out of engagement with a first portion of a pod shell upon rotation of said rotatable actuator;

an angled member positioned to lever the latching member into contact with a second portion of the pod shell as the latching member moves into engagement with the first portion; and a positioning member movably mounted to the rotatable actuator and independently movable with respect to the latching member, said positioning member being contained within a footprint of the pod door when in a first position and extending beyond the footprint of the pod door when in a second position to engage the pod shell, the positioning member adjusting the position of the pod door with respect to the pod shell before the latching mechanism completely engages the pod shell.

3. A mechanism as recited in claim 2, wherein the pod door alignment device is adapted to align a pod door in a bottom opening pod.

4. A mechanism as recited in claim 2, wherein the pod door alignment device is adapted to align a pod door in a front opening pod.

5. A mechanism as recited in claim 2, wherein said positioning member prevents shifting of the pod door with respect to the pod shell when the pod door is latched to the pod shell.

6. A mechanism as recited in claim 2, wherein multiple positioning members are capable of extending out beyond said footprint of the pod along a same side of the pod.

7. A mechanism as recited in claim 2, wherein the positioning members are positioned so as to extend through openings on multiple sides of the pod door.

8. A mechanism for positioning a pod door with respect to an opening in a pod shell and latching the pod door to the pod shell, the mechanism comprising:

a latching member adapted to be movably mounted to a pod door;

an actuator connected to said latching member and including a cam, said actuator being capable of moving the latching member into and out of engagement with a first portion of a pod shell;

an angled member positioned to lever the latching member into contact with a second portion of the pod shell as the latching member moves into engagement with the first portion; and a positioning member movably mounted to the actuator and independently movable with respect to the latching member, said positioning member being contained within a footprint of the pod door when in a first position and extending beyond the footprint of the pod door when in a second position to engage the pod shell, the positioning member establishing a predetermined spacial relation between the pod door and pod shell before the latching mechanism completely engages the pod shell, the positioning member including a cam following member circumjacent about the cam, and the positioning member including an arm portion having a first end engaged with the cam following member and a second end opposite the first end capable of extending beyond the footprint of the pod door.

9. A mechanism as recited in claim 8, further comprising a spring for biasing said positioning member into said first position.

10. A mechanism as recited in claim 8, wherein said second end is capable of extending between 1mm to 4 mm beyond the footprint of the pod door.

11. A pod door assembly having an alignment and latching mechanism, the pod door assembly comprising:

a pod door adapted to mate with an opening in a pod shell;

a latching member movably connected to the pod door;

an actuator connected to said latching member, said actuator being capable of moving the latching member into and out of engagement with the pod shell;

a cam provided on said actuator; and a positioning member movably mounted in the pod door and independently movable with respect to the latching member, said positioning member having a first end provided circumjacent about said cam and a second end opposite said first end, the positioning member capable of occupying a first position completely contained within a footprint of the pod door and a second position where said second end extends beyond said footprint and into engagement with the pod shell to center the pod door in the opening in the pod shell, the positioning member moving between said first and second positions upon rotation of the actuator as the latching member moves into engagement with the pod shell.

12. A door assembly having a mechanism for positioning a door with respect to an opening in a container and latching the door to the container, the door assembly comprising:

a door adapted to be received by an opening in a container;

a latching member movably connected to the door;

a rotatable actuator connected to the latching member, said rotatable actuator moving the latching member in a plane parallel to the door so as to engage the container upon rotation of the rotatable actuator; and a positioning member movably mounted to the door and independently movable with respect to the latching member between a first position that does not extend past an edge of the door and a second position where at least a portion of the positioning member extends beyond an edge of the door, the positioning member adjusting the position of the door with respect to the opening in the container as the latching mechanism engages the container.

13. A door assembly according to claim 12, wherein the actuator is further adapted to move the positioning member.

14. A door assembly according to claim 12, wherein the actuator comprises a rotating latch hub engaged with a pair of latching members.

15. A door assembly according to claim 12, further comprising a cam for the positioning member, the cam in contact with the actuator, the cam comprising a raised wall on the surface of the actuator adapted to cause movement of the positioning member upon rotation of the cam.

16. A door assembly according to claim 15, wherein the raised wall includes sections that lie at varying distances from the radial center of the actuator.

17. A door assembly according to claim 12, further comprising a spring in contact with the positioning member and the actuator, the spring adapted to bias the positioning member toward the radial center of the actuator.

18. A door assembly having a mechanism for positioning a door with respect to an opening in a container and latching the door to the container, the door assembly comprising:

a door adapted to be received by an opening in a container;

a latching member movably connected to the door;

an actuator connected to the latching member, said actuator being capable of moving the latching member in a plane parallel to the door so as to engage the container;

a positioning member movably mounted to the door and independently movable with respect to the latching member, the positioning member movable between a first position that does not extend past an edge of the door and a second position where at least a portion of the positioning member extends beyond an edge of the door, the positioning member positioning the door with respect to the opening in the container before the latching mechanism completely engages the container; and ramps on the actuator adapted to lever the latching member in a direction perpendicular to the plane of the door such that a side of the latching member parallel to the plane of the door forcibly contacts the container, thereby pulling the door tightly against the container.

19. A door assembly having a mechanism for positioning a door with respect to an opening in a container and latching the door to the container, the door assembly comprising:

a door adapted to be received by an opening in a container;

a latching member movably connected to the door;

an actuator connected to the latching member, said actuator capable of moving the latching member in a plane parallel to the door so as to engage the container;

a positioning member movably mounted to the door and independently movable with respect to the latching member, the positioning member movable between a first position that does not extend past an edge of the door and a second position where at least a portion of the positioning member extends beyond an edge of the door, the positioning member positioning the door with respect to the opening in the container before the latching mechanism completely engages the container; and a multiple apex cam for the positioning member, the multiple apex cam in contact with the actuator and comprising a raised wall on the surface of the actuator adapted to cause movement of the positioning member upon rotation of the cam, said multiple apex cam being adapted to cause movement of a plurality of positioning members, each positioning member adapted to move in a different direction.

20. A mechanism for centering a pod door with respect to an opening in a pod shell and latching the pod door to the pod shell, the mechanism comprising:

means for latching a pod door to a pod shell;

means for adjusting the position of the pod door with respect to an opening in the pod shell after the pod door is placed in the opening but before said latching means finishes latching the pod door to the pod shell, said centering means being independently movable with respect to said latching means; and means for concurrently actuating said latching means and said adjusting means.

21. A mechanism according to claim 20, wherein said adjusting means centers the pod door with respect the opening in the pod shell before said latching means finishes latching the pod door to the pod shell.

* * * * *